United States Patent [19]

Takagi et al.

[11] Patent Number: 4,871,512

[45] Date of Patent: Oct. 3, 1989

[54] ALLOYS FOR EXHAUST VALVE

[75] Inventors: Yoshiaki Takagi, Saitama; Susumu Isobe, Aichi; Kenkichi Matsunaga, Gunma, all of Japan

[73] Assignees: Daido Tokushuko K.K.; Honda Giken Kogyo K.K., both of Japan

[21] Appl. No.: 914,408

[22] Filed: Oct. 2, 1986

Related U.S. Application Data

[63] Continuation-in-part of Ser. No. 798,061, Nov. 14, 1985, abandoned.

[30] Foreign Application Priority Data

Nov. 16, 1984 [JP] Japan ..... 59-240432

[51] Int. Cl.[4] ..... C22C 19/05

[52] U.S. Cl. ..... 420/448; 420/443

[58] Field of Search ..... 420/448, 443; 148/410, 148/428

[56] References Cited

U.S. PATENT DOCUMENTS 3,046,108 7/1962 Eiselstein ..... 420/448

*Primary Examiner*—R. Dean

*Attorney, Agent, or Firm*—Sughrue, Mion, Zinn, Macpeak & Seas

[57] ABSTRACT

An alloy for use in an exhaust valve of an automotive vehicle is disclosed, which consists of C: 0.01–0.15%, Si≦2.0%, Mn≦0.5%; Cr: 15–25%, Mo: 0.4–3.1% and W: 0.2–3.8% so that (Mo+½W) is 0.5 to 5.0%, Nb+Ta: 0.3–3.0%, Ti: 1.5–3.5%, Al: 0.5–2.5%, B: 0.001–0.02%, Fe≦5% and the balance of Ni or Ni+Co.

4 Claims, 1 Drawing Sheet

ALLOYS FOR EXHAUST VALVE

CROSS-REFERENCE TO RELATED APPLICATION

This application is a continuation-in-part of U.S. Ser. No. 798,061, filed Nov. 14, 1985, abandoned.

BACKGROUND OF THE INVENTION

1. Field of the Invention

This invention relates to an alloy suitable for use in exhaust valves of various internal-combustion engines.

2. Related Art Statement

In order to attain high power of the engines, there is recently a tendency that the number of valves are set into three per one cylinder in the conventional SOHC (single overhead cam shaft type) engines or four per one cyclinder in DOHC (double overhead cam shaft type) engines instead of SOHC engines. With such a tendency, the reduction in a diameter of an engine valve is rapidly promoted in order to satisfy the requirement on high revolution and high power of the engines. On the other hand, high manganese austenite steel of SUH 36 (Fe-8.5Mn-21Cr-4Ni-0.5C-0.4N) has hitherto been used as a material of an exhaust valve in gasoline engines, diesel engines or the like.

However, it is demanded to adopt materials for exhaust valves having a high temeprature strength higher than that of SUH 36 in accordance with the tendency of a valve diameter reduction as mentioned above.

As the high strength material for exhaust valves, there have hitherto been known nickel-based heat resistant alloys of NCF 751 (Ni-15.5Cr-1Nb-2.3Ti-1.2Al-7Fe) and NCF 80A (Ni-19.5Cr-2.5Ti-1.4Al). They are used as a material requiring no stellite surfacing, but are inexpressible to sufficiently satisfy the high temperature strength required by the above diameter reduction.

SUMMARY OF THE INVENTION

The invention have aimed at the aforementioned circumstances and is to provide an alloy for high strength valve having high temperature strength higher than that of the conventional Ni-based heat resistant alloy and an excellent hot workability as a valve material. As a result of various studies, the invention has been accomplished by developing an alloy for exhaust valves composed of Ni-based heat resistant alloy having sufficiently objective properties.

BRIEF DESCRIPTION OF THE DRAWING

A single FIGURE is a graph showing results on overaging resistance in the alloys according to the invention and comparative alloy.

DETAILED DESCRIPTION OF THE INVENTION

Figure 1:
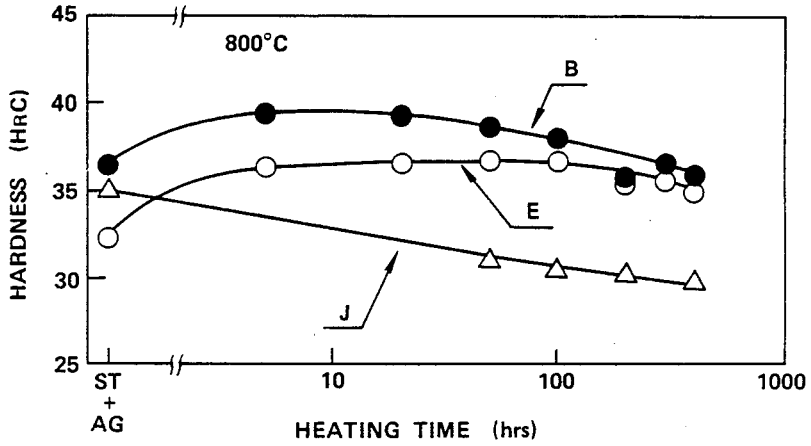

According to the invention, there is the provision of an alloy for use in an exhaust valve consisting by weight percentage of 0.01 to 0.15% of C, not more than 2.0% of Si, not more than 2.5% of Mn, 15 to 25% of Cr, 0.4 to 3.1% of Mo and 0.2 to 3.8% of W so that (Mo+$\frac{1}{2}$ W) is 0.5 to 5.0%, 0.3 to 3.0% of NB+Ta, 1.5 to 3.5% of Ti, 0.5 to 2.5% of Al, 0.001 to 0.02% of B, not more than 5% of Fe and the balance being substantially Ni (a part of Ni may be replaced with Co).

The reason why the components in the alloy according to the invention are limited to the above defined composition range (percent by weight) will be described below.

C: 0.01 to 0.15%.

C is an element effective for enhancing the high temperature strength by bonding with Cr, Nb or Ti to form a carbide. In order to provide such an effect, it is necessary to add C in an amount of at least 0.01%. However, if a large amount of C is added, the strength, toughness and ductility at high temperature lower, so that the upper limit is 0.15%.

Si: not more than 2.0%.

Si is required as a deoxidation element. If the amount of Si added is too large, there are lowered not only the strength, toughness and ductility but also the resistance to PbO attack, so that the amount of Si is limited to not more than 2.0%.

Mn: not more than 2.5%

Mn is added as a deoxidation element likewise Si. If the amount of Mn added is too large, the oxidation resistance at high temperature lowers, so that the Mn amount is limited to not more than 2.5%.

Cr: 15 to 25%.

Cr is an element required for maintaining the oxidation resistance and corrosion resistance at high temperature. For this purpose, it is necessary to add Cr in an amount of at least 15%. However, if the addition amount is too large, the austenite phase becomes unstable and brittle phases such as $\sigma$ phase, $\alpha$ phase and the like are precipitated to lower the strength, toughness and ductility, so that the upper limit is 25%, preferably less than 21% as a material for exhaust valves.

Mo: 0.4 to 3.1%.

W: 0.2 to 3.8%.

(Mo+$\frac{1}{2}$ W): 0.5 to 5.0%.

Mo and W are elements effective for enhancing high temperature strength by soluting into austenite phase to develop the reinforcing action of solid solution. Since the atomic weight of W is about two times than that of Mo, the effect of W is about a half of the effect of Mo at the same weight percentage. Further, Mo and W are elements effective for increasing the corrosion resistance without deteriorating the high temperature strength and the oxidation resistance. Therefore, an alloy for exhaust valves which is excellent in high temperature strength and corrosion resistance is obtained by simultaneously adding of Mo and W. In order to provide the above effect, it is necessary to add Mo in an amount of at least 0.4%, W in an amount of at least 0.2% and (Mo+$\frac{1}{2}$ W) in an amount of at least 0.5%. However, if the addition amount is too large, not only the hot workability lowers, but also the brittle phase is precipitated likewise the case of Cr, so that the upper limit of Mo is 3.1%, the upper limit of W is 3.8% and the upper limit of (Mo+$\frac{1}{2}$ W) is 5.0%.

Nb+Ta: 0.3 to 3.0%.

Nb and Ta are elements effective for enhancing the high temperature strength by the formation of carbide {NbC}, {TaC} or $\gamma'$ phase {$Ni_3$(Al, Ti, Nb, Ta)}. In order to provide such an effect, it is necessary to add NB+Ta in an amount of at least 0.3%. If the addition amount is too large, $\delta$ phase {$Ni_3$(Nb, Ta)} is precipitated to lower the strength, toughness and ductility at high temperature and to degrade the oxidation resistance and corrosion resistance, so that the upper limit is 3.0%. Moreover, the fact that either Nb or Ta is less than the effective amount is included in the invention.

Ti: 1.5 to 3.5%.

Ti is an important element bonding with Ni to form $\gamma'$ phase required for maintaining the high temperature strength. If the addition amount is too small, the precipitation amount of $\gamma'$ phase is insufficient and the satisfactory strength can not be obtained, while if it is too large, not only the hot workability is degraded, but also $\eta$ $\{Ni_3Ti\}$ is precipitated to lower the strength. Therefore, the addition amount of Ti is limited to a range of 1.5 to 3.5%.

Al: 0.5 to 2.5%.

Al is an element effective for enhancing the high temperature strength by bonding with Ni to form $\gamma'$ phase likewise the case of Ti. When the addition amount is too small, not only the precipitation amount of $\gamma'$ phase is reduced and the $\gamma'$ phase itself becomes unstable, but also $\eta$ phase is precipitated to lower the strength, so that it is necessary to add Al in an amount of not less than 0.5%. On the other hand, when the addtion amount is too large, the hot workability is degraded and the formation of the valve is difficult, so that the upper limit is 2.5%.

B: 0.001 to 0.02%.

B enhances not only the creep strength by segregation into crystal grain boundary but also the hot workability at a small addition amount. In order to sufficiently develop such effects, it is necessary to add B in an amount of not less than 0.001%. However, if the addition amount is too large, the hot workability lowers, so that the upper limit is 0.02%.

Fe: not more than 5.0%.

Fe is not an element to be positively added in view of the high temperature strength of the alloy for the exhaust valves according to the invention, but may be added within a range causing no obstacle because it is difficult to avoid the inclusion from the starting material (inclusive of returning material) and the like and at the same time the production cost can considerably be reduced by existing addition elements in the form of Fe alloy. In this case, if the addition amount of Fe is not more than 5%, the decrease of the high temperature strength is slight, so that the upper limit is 5%.

Besides, at least one element of Mg, Ca and REM, whose effect is apparent from the previous application filed by the inventors (Japanese Patent Application No. 58-154504), may effectively be added in an amount of 0.001 to 0.03% to the alloy according to the invention to improve the hot workability.

Ni: balance.

Ni is an element forming a stable austenite phase to improve the corrosion resistance and heat resistance of the alloy, so that the balance of the alloy according to the invention is restricted to Ni. Moreover, the excellent properties aiming at the invention can be obtained even when a part of Ni is replaced with Co.

The following example is given in the illustration of the invention and is not intended as limitation thereof.

EXAMPLE

An alloy material having a chemical composition shown in the following Table 1 was melted in a high frequency vacuum induction heating furnace, and then cast into an ingot of 30 kg in weight.

TABLE 1

| | Chemical composition (wt %) | | | | | | | | | | |
|---|---|---|---|---|---|---|---|---|---|---|---|
| | C | Ni | Cr | Mo | W | Nb + Ta | Ti | Al | B | Fe | Co |
| A | 0.04 | Bal. | 19.11 | 3.01 | — | 0.97 | 2.59 | 1.49 | 0.005 | 0.15 | — |
| B | 0.04 | " | 19.12 | 3.00 | — | 1.97 | 2.59 | 1.43 | 0.005 | 0.04 | — |
| C | 0.04 | " | 15.17 | 3.01 | 0.85 | 1.00 | 2.61 | 1.43 | 0.005 | 1.25 | — |
| D | 0.05 | " | 21.84 | 1.81 | 2.04 | 0.92 | 2.63 | 1.38 | 0.006 | 0.21 | — |
| E | 0.05 | " | 19.15 | 4.95 | — | 0.99 | 2.61 | 1.43 | 0.006 | 2.03 | — |
| F | 0.04 | " | 18.52 | 1.63 | 2.27 | 1.01 | 2.83 | 1.13 | 0.004 | 0.81 | — |
| G | 0.05 | " | 18.86 | 2.98 | — | 0.97 | 2.30 | 1.82 | 0.005 | 0.22 | — |
| H | 0.04 | " | 19.24 | 3.01 | — | — | 2.63 | 1.41 | 0.005 | 0.37 | — |
| I | 0.05 | " | 19.17 | — | — | 1.03 | 2.65 | 1.48 | 0.004 | 0.83 | — |
| J | 0.06 | " | 15.50 | — | — | 0.97 | 2.35 | 1.25 | — | 6.71 | — |
| K | 0.04 | " | 19.15 | 3.01 | 2.45 | 2.02 | 2.53 | 1.42 | 0.005 | 0.13 | — |
| L | 0.04 | " | 19.16 | 0.53 | 0.28 | 1.03 | 2.58 | 1.46 | 0.005 | 0.21 | — |
| M | 0.04 | " | 19.20 | 3.00 | 2.25 | 0.99 | 2.38 | 1.43 | 0.005 | 0.16 | 4.5 |

Note
In the alloys A-1 and K-M, the amount of each of Si and Mn was not more than 0.5%. Moreover, the alloy J coresponded to NCF 751.

The resulting ingot was subjected to a soaking treatment at 1150° C. for 16 hours, and then scarfed, and further subjected to forging and rolling at a temperature region of 1180°-1000° C. to form a rod of 16 mm in diameter, during which it has been confirmed that the alloy according to the invention produces no crack at the forging and rolling and has an excellent hot workability. Thereafter, the rod was subjected to a solid solution treatment (oil cooling after the heating at 1050° C. for 30 minutes) and an aging treatment (air cooling after the heating at 750° C. for 4 hours), and then the properties thereof were evaluated as follows.

(1) High temperature tension properties

Since the valve is repeatedly subjected to tensile stress by a reaction force of a valve spring during the operation of the engine, it is required to have excellent tension properties near the operating temperature.

Therefore, the high temperature tension test at 800° C. was performed. The thus obtained results are shown in the following Table 2.

TABLE 2

| | 0.2% Proof strength ($kgf/mm^2$) | Tensile strength ($kgf/mm^2$) | Elongation (%) | Draw ratio (%) |
|---|---|---|---|---|
| A | 70.1 | 73.7 | 9.2 | 15.3 |
| B | 73.0 | 77.0 | 5.8 | 12.6 |
| C | 64.1 | 67.7 | 7.6 | 12.1 |
| D | 70.8 | 74.1 | 8.7 | 14.7 |
| E | 69.5 | 73.2 | 10.9 | 20.8 |
| F | 72.1 | 76.4 | 6.8 | 12.1 |
| G | 65.2 | 71.6 | 11.9 | 17.9 |
| H | 59.7 | 65.0 | 11.0 | 20.3 |
| I | 62.3 | 66.8 | 9.6 | 17.9 |
| J | 54.0 | 64.5 | 5.8 | 10.0 |
| K | 75.3 | 79.0 | 5.5 | 11.8 |
| L | 66.3 | 70.2 | 9.4 | 18.5 |
| M | 70.4 | 72.1 | 7.6 | 16.9 |

As shown in Table 2, it is apparent that the alloys A-G and K-M are superior in the 0.2% proof strength and tensile strength at 800° C. to the existing Ni-based alloy J, the comparative alloy H containing no Nb and Ta and the comparative alloy I containing no Mo and W.

(2) Resistance to overaging

The exhaust valve is required to diminish the reduction of hardness in use because it is used at higher temperature for a long period of time.

Now, the change of hardness was examined by heating each of the alloys (typically alloys B, E and K) and the existing Ni-based alloy J at 800° C. being near the use temperature of the exhaust valve for 400 hours at most. The thus obtained results are shown in the single FIGURE.

As apparent from the FIGURE, the existing Ni-based alloy J gradually reduces the hardness with the lapse of the heating time, and reaches $H_RC$ of 30 after the heating for 400 hours, while in the alloys B, E and and K the hardness tends to rise once at a short heating time and gradually reduce and is maintained at a high value of about $H_RC=35$ even after the heating for 400 hours. That is, the alloys B, E and K satisfy such a requirement that the reduction of hardness is small even after the use for a long period of time.

(3) High temperature fatigue strength

Since the exhaust valve is repeatedly subjected to tensile stress as mentioned above, it is required to have a high fatigue strength near the operating temperature.

Now, the time strength at $10^7$ cycles was measured by a rotary bending fatigue test at 800° C. with respect to the alloys. The thus obtained results are shown in the following Table 3.

TABLE 3

| | A | B | C | D | E | F | G | H | I | J | K | L | M |
|---|---|---|---|---|---|---|---|---|---|---|---|---|---|
| Time strength ($\sigma(A10^7)$kgf/mm$^2$) | 40.5 | 41.5 | 40.0 | 38.5 | 37.0 | 40.5 | 38.5 | 35.0 | 36.5 | 34.5 | 41.7 | 37.5 | 40.7 |

As apparent from Table 3, the fatigue strength at 800° C. of the alloys A–G and K–M are higher than that of the comparative alloys H–J inclusive of the existing alloy J.

(4) Oxidation resistance and resistance to PbO attack

Since the operating temperature of the exhaust valve tends to rise with the enhancement of engine performances, the valve material is required to have an excellent oxidation resistance.

Now, the weight increase by oxidation was measured by heating each of the invention alloys and comparative alloys in a static air at 900° C. for 200 hours. The thus obtained results are shown in the following Table 4.

TABLE 4

| | A | B | C | D | E | F | G | H | I | J | K | L | M |
|---|---|---|---|---|---|---|---|---|---|---|---|---|---|
| Weight increase by oxidation (mg/cm$^2$) | 1.5 | 1.6 | 1.6 | 1.4 | 1.6 | 1.4 | 1.6 | 1.4 | 1.4 | 1.7 | 1.3 | 1.6 | 1.4 |

As apparent from Table 4, the oxidation resistance of the each invention alloy is substantially equal to or excellent than that of the existing Ni-based alloy J.

Moreover, gasoline may be used by adding tetraethyl lead in order to increase the octane value. In this case, lead oxide (PbO) is produced as a combustion product and adheres to the surface of the exhaust valve, resulting in the occurrence of high temperature corrosion (i.e. PbO attack).

Therefore, the resistance to PbO attack is an important property in the valve material. Moreover, the combustion product adhered to the valve surface is scarcely a pure PbO, but is frequently a mixture of PbO and lead sulfate ($PbSO_4$). The coexistence of PbO and $PbSO_4$ produces a more violent corrosion because of S attack proceeds simultaneously.

The corrosion test (920° C., 1 hour) in a mixed ash of PbO and $PbSO_4$ ($PbO:PbSO_4=6:4$) was performed with respect to the alloys. The thus obtained results are shown in the following Table 5.

TABLE 5

| | A | B | C | D | E | F | G | H | I | J | K | L | M |
|---|---|---|---|---|---|---|---|---|---|---|---|---|---|
| Weight loss by corrosion (mg/cm$^2$) | 748 | 793 | 792 | 719 | 788 | 783 | 760 | 790 | 758 | 765 | 746 | 786 | 753 |

As shown in Table 5, all of the invention alloys have a corrosion resistance approximately equal to that of the existing Ni-based alloy J, and are sufficiently usable as a valve alloy requiring no stellite surfacing.

As mentioned above, the alloy for use in the exhaust valve according to the invention consists by weight percentage of 0.01 to 0.15% of C, not more than 2.0% of Si, not more than 2.5% of Mn, 15 to 25% of Cr, 0.4 to 3.1% of Mo and 0.2 to 3.8% of W so that ($Mo+\frac{1}{2}W$) is 0.5 to 5.0%, 0.3 to 3.0% of Nb+Ta, 1.5 to 3.5% of Ti, 0.5 to 2.5% of Al, 0.002 to 0.02% of B, not more than 5% of Fe and the balance being substantially Ni (a part of Ni may be replaced with Co), so that it is excellent in the high temperature tension properties as compared with the conventionally used Ni-based heat resistant alloys (e.g., NCF 51 material), small in the reduction of hardness after the use at high temperature for a long period of time, large in the high temperature fatigue strength and has the oxidation resistance and resistance to PbO attack equal to those of the Ni-based heat resistant alloy. That is, the alloys according to the invention have considerably excellent properties as an alloy material for an exhaust valve.

What is claimed is:

1. An alloy for use in an exhaust valve consisting by weight percentage of 0.01 to 0.15% of C, not more than 2.0% of Si, not more than 2.5% of Mn, 15 to 25% of Cr, 0.4 to 3.1% of Mo and 0.2 to 3.8% of W so that (Mo+½ W) is 0.5 to 5.0%, 0.3 to 2.02% of Nb+Ta, 1.5 to 3.5% of Ti, 0.5 to 2.5% of Al, 0.001 to 0.02% of B, not more than 5% of Fe and the balance being substantially Ni.

2. An alloy for use in an exhaust valve consisting by weight percentage of 0.001 to 0.15% of C, not more than 2.0% of Si, not more than 2.5% of Mn, 15 to less than 21% of Cr, 0.4 to 3.1% of Mo and 0.2 to 3.8% of W so that (Mo+½ W) is 0.5 to 5.0%, 0.3 to 2.02% of Nb+Ta, 1.5 to 3.5% of Ti, 0.5 to 2.5% of Al, 0.001 to 0.02% of B, not more than 5% of Fe and the balance being substantially Ni.

3. An alloy for use in an exhaust valve as in claim 1, wherein the weight percentage of Al is at least 1.13%.

4. An alloy for use in an exhaust valve as in claim 2, wherein the weight percentage of Al is at least 1.13%.

* * * * *